US006402571B1

(12) United States Patent
Muller et al.

(10) Patent No.: US 6,402,571 B1
(45) Date of Patent: Jun. 11, 2002

(54) ELECTRICAL SOCKET CONTACT WITH GUIDE RAIL

(75) Inventors: Steffen Muller, Nuremberg; Harald Lutsch, Rosstal, both of (DE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/661,953

(22) Filed: Sep. 14, 2000

(30) Foreign Application Priority Data

Sep. 15, 1999 (DE) ..... 199 44 280

(51) Int. Cl.[7] ..... H01R 13/434
(52) U.S. Cl. ..... 439/745; 439/844; 439/856
(58) Field of Search ..... 439/856, 745, 439/748, 844, 845

(56) References Cited

U.S. PATENT DOCUMENTS 4,834,681 A 5/1989 Chaillot ..... 439/856
5,634,825 A * 6/1997 Maki ..... 439/745
5,685,746 A 11/1997 Maejima ..... 439/845

FOREIGN PATENT DOCUMENTS

| | | |
|---|---|---|
| DE | 19602822 C2 | 7/1997 |
| EP | 0189821 A2 | 8/1986 |
| EP | 0577927 A1 | 1/1994 |

* cited by examiner

*Primary Examiner*—Tho D. Ta
*Assistant Examiner*—Truc Nguyen
(74) *Attorney, Agent, or Firm*—Perman & Green, LLP

(57) ABSTRACT

The present invention concerns an electrical socket contact (1) with a base part (2) and two contact spring arms (7) integrated on the base part. The socket contact also has a guide rail (8) which is integrated on the base part in an offset position in relation to the spring arms (7) and which on the introduction of a contact pin of a complementary plug guides and centres the said contact pin.

9 Claims, 2 Drawing Sheets

ELECTRICAL SOCKET CONTACT WITH GUIDE RAIL

FIELD OF THE INVENTION

The present invention concerns an electrical socket contact with a box-shaped base part with four side walls and a rear connection part for the reception of a conductor wire. Such socket contacts also possess at least two spring arms which are integrated on the side walls in the base part and are arranged opposite and bent towards one another via parts of their lengths and bent back at their flee ends.

BACKGROUND OF THE INVENTION

Such socket contacts are normally stamped from metal sheet and brought to their ultimate shape, which keeps the cost of manufacture of such socket contacts low. U.S. Pat. No. 4,834,681 discloses an electrical contact which in order to receive an electrical contact pin, possesses two spring arms arranged opposite one another which form the contact part.

EP-B1-0 189 821 discloses a double-faced electrical spring contact which possesses a central box-shaped spring base part with a ceiling pail, two side walls and a floor part. Furthermore, two pairs of spring arms are provided, which are integrated on the floor and the ceiling parts.

Such socket contacts have the drawback that when a contact pin of a complementary plug is introduced, the contact pin is only centred and guided by the two opposed spring arms. A guidance on both sides vertically to the spring arms can take place via an optional box spring, but in this case the axial clearance is greater and the degree of static definition as against the newly described principle of contact is accordingly smaller. This can, in the case of oscillations, vibrations or similar stresses, lead to an increased tendency of the socket system towards fretting corrosion, especially with contact surfaces which are of a base metal such as tin. The consequence is a strong rise of the contact resistance, up to a complete failure of the connector system.

SUMMARY OF THE INVENTION

It is the purpose of the invention to provide a better guidance, both of the contact pin of a complementary plug during the introduction into the socket contact (reduction of the degree of freedom) as well as of the box spring in relation to the contact base (reduction of the tendency to tip), whilst retaining a relatively soft spring characteristic which makes it possible to insert various thickness pins, ideally 0.6 mm and 0.8 mm with either a base metal or a noble metal coating.

This purpose is performed by an electrical socket contact which has a guide rail offset with respect to the spring arms and integrated on the periphery of the base part and whose free end extends in the direction of the free end of the contact spring arm, making it possible during the introduction of a counterplug to guide the contact pin not only on both sides of the spring arms, but also, on one side, vertically to the same. This leads to a reduction of the degree of freedom of the pin which has been introduced and thereby also to a reduction of the tendency towards the fretting corrosion.

Preferably, the socket contact is formed form a steel sheet blank so that the manufacture can be carried out simply and cheaply.

The guide rail can be introduced in one or in two parts, where the two halves of the guide rail can be separated from one another by a slot. If the socket contact is made from a steel sheet blank, the guide rail can either be in one part in which case it can be arranged vertically to the plug axis of the socket contact, or, in the case of a two-part guide rail, vertically to the plug axis of the socket contact at both outer ends of the steel sheet blank. In the latter case, the parts of the two-part guide rail lie, after shaping by bending, flush against one another. The two spring arms of the socket contact are preferably slotted, where the slots cannot extend as far as the junction of the spring arms part and the basis part.

The spring arms can be so shaped that, depending on an increasing spring stretch of the base contact, they may alter the support point of the spring arms of the contact base on the inner face of an optional box spring. With an increasing spring path, the support point may wander in the direction of the insertion opening which in turn leads to an increase in the perpendicular contact force.

Furthermore, an extension can be present on the side of the socket contact, lying opposite the guide rail, namely, a second guide rail, whose free end extends against the direction of insertion and lies approximately opposite the free end of the guide rail. This improves further the centering of the contact pin so that an insertion of the contact pin at an angle, that is to say, not parallel to the plug axis, is almost completely prevented.

The box spring can be inserted on the socket contact, whereby the box spring, the guide rail and the spring contact arms form a closed rotating sleeve.

The socket contact can be better protected from external influences and an exact, largely backlash-free fixing of the box spring on the contact base is achieved.

The box spring may have two links bent inwards, whose free ends surround the ends of the spring arms of the contact base. Depending on the spring arms of the contact base and the internal dimensions of the two links, it is possible, during the fitting of the box spring on the contact base, to hold the spring arms in such a way that a slit forms between the said spring arms.

BRIEF DESCRIPTION OF THE DRAWINGS

The embodiment examples of the invention which appear below are explained more fully by reference to the appended drawings

DETAILED DESCRIPTION OF THE INVENTION

Figure 1:
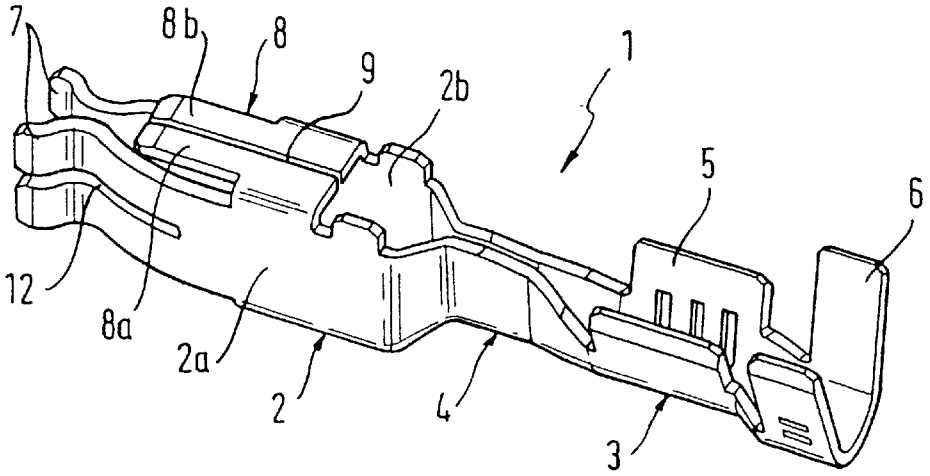
FIG. 1 shows a perspective view diagonally from above of a socket contact according to the invention.

FIG. 1 shows the socket contact 1 which has a base part 2 with two side faces 2*a* and 2*b*. Behind the base part 2 is a transition part 4, to which is connected the rear connection part 3. This connection part 3 consists of two crimping barrels 5 and 6 for a conductor wire (not shown) and for the conductor wire insulation.

As an extension of the side walls 2*a* and 2*b*, there are the two spring arms 7 and the guide rail 8 offset with respect to the spring arms 7. The guide rail can consist of two parts, 8*a* and 8*b*, which are separated from one another by means of a slit 9.

Figure 2:
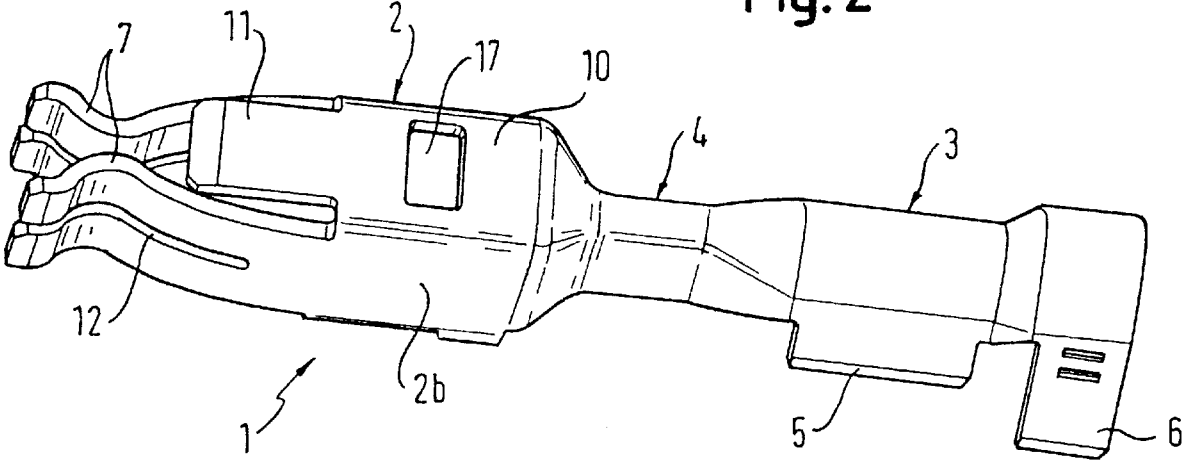
FIG. 2 shows a perspective view diagonally from below of a socket contact according to the invention.

FIG. 2 shows the socket. contact 1 seen diagonally from below. The base part 2 has a floor 10 at the front end of which is formed an extension 11. The side walls 2*a* and 2*b*, the floor 10 and the guide rail 8 form the four side walls of the base part. In the floor is a recess 17 in which a box spring 13 shown in FIG. 3 can be secured to the socket contact. Each spring arm 7 can be divided into two single spring arms by means of a channel 12, so that when a contact pin 20 is introduced, a total of four contact faces results.

Figure 3:
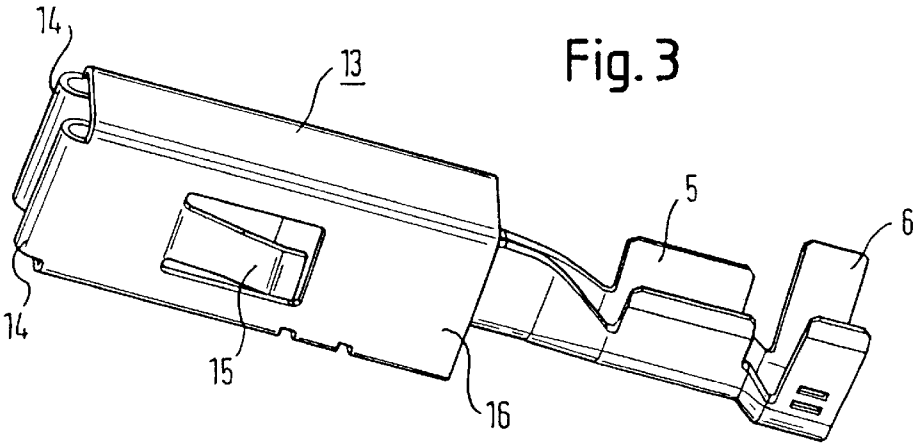
FIG. 3 shows the socket contact after the fitting of a box spring.

FIG. 3 shows the box spring 13 inserted on the socket contact 1. On the end of the box spring 13 are located two links 14 whose front ends are bent inwards. In the side walls 16 of the box spring 13, two ends 15 are cut out and bent outwards.

Figure 4:
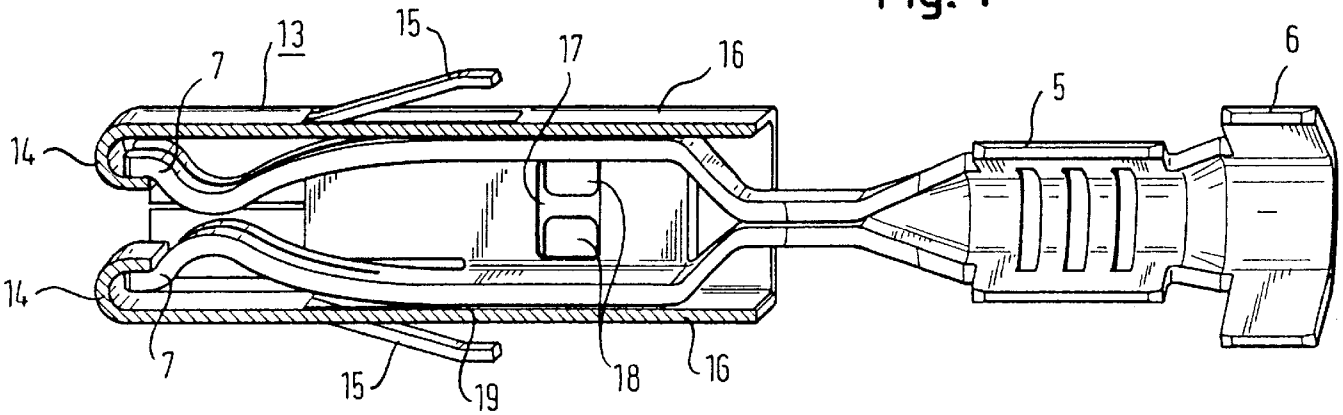
FIG. 4 shows a longitudinal section through the socket contact with the box spring in place.

FIG. 4 shows in part-section the front part of the socket contact with the box spring. In the floor part of the box spring 13, two flee ends 18 grip into a channel 17 of the socket contact 1 in order to lock the box spring 13 over the socket contact 1.

The inwards bent ends of the links 14 keep flee ends of the spring arms 7 under preliminary tension, so that an air gap forms in the parts of the spring arms 7 which are bent towards one another via their part lengths. In the same way, the box spring can nevertheless be formed in such a way that no air gap forms between the spring arms 7.

By means of the arrangement of the box spring 13 over the socket contact 1, a support point 19 of the spring arms 7 forms on the box spring 13. If a contact pin is introduced into the socket contact, the pre-tensioned spring arms 7 are forced further apart, the support point 19 of the spring arms on the box spring shifts in the direction of the front opening of the socket contact and the spring arm shortens so that the perpendicular force acting on the contact pin rises.

By means of the socket contact according to the invention, the introduction of the contact pin of a counterplug becomes easier, since the said contact pin is centered and guided not only by the spring arms, but also by the guide rail. An oblique introduction at any desired angle in relation to the plug axis is prevented by the guide rail according to the invention, whereby the complete socket contact and a possible box spring are better protected from deformation.

What is claimed is:

1. An electrical socket contact (1) with a box-shaped base part (2) with four side walls, a rear connection part (3) for receiving a conductor wire, at least two opposed contact spring arms (7) integrated on the base part (2) on two side walls which are arranged over part lengths at a distance from one another bent towards one other and bent back at their free ends, characterised by at least one guide rail (8) which is offset in relation to the spring arms (7) and integrated on a periphery of the base part (2) and whose free end extends in the direction of the free end of the contact spring arms (7), wherein said free end of said guide rail is located proximate to contact faces of said contact spring arms.

2. An electrical socket contact according to claim 1 characterised by the fact that the socket contact (1) is formed from a steel sheet blank.

3. An electrical socket contact according to claim 1, characterised by the fact that the guide rail (8) is divided into two parts and that both the halves (8*a*, 8*b*) are separated by means of a slot (9).

4. An electrical socket contact according to claim 1, characterised by the fact that both halves (8*a*, 8*b*) are arranged vertically at both outer ends to the plug axis and after the forming of the sheet blank lie flush against one another.

5. An electrical socket contact according to claim 1, characterised by the fact that on the side of the base part (2) opposite the guide rail, there is an extension (11) which forms a second guide rail extending substantially parallel to the guide rail against the direction of insertion.

6. An electrical socket, contact (1) according to claim 1, characterised by a box spring (13) which is inserted on the socket contact (1), whereby the box spring (13), the guide rail (8) and the contact spring arms (7) form a closed sleeve.

7. An electrical socket contact (1) according to claim 6, characterised by the fact that the box spring (13) has two links (14) on the insertion side whose free ends are bent inwards and are directed into the sleeve.

8. An electrical socket contact according to claim 1, characterised by the fact that the inward bent links (14) of the box spring (13) surround the free ends of the spring arms (7).

9. An electrical socket contact (1) with a box-shaped base part (2) with four side walls, a rear connection part (3) for receiving a conductor wire, at least two opposed contact spring arms (7) integrated on the base part (2) on two side walls which are arranged over part lengths at a distance from one another bent towards one other and bent back at their free ends, characterised by at least one guide rail (8) which is offset in relation to the spring arms (7) and integrated on a periphery of the base part (2) and whose free end extends in the direction of the free end of the contact spring. arms (7), wherein the guide rail guides a contact pin along a plug axis and wherein the guide rail prevents an oblique introduction of the contact pin at an angle relative to the plug axis; wherein said free end of said guide rail is located proximate to contact f aces of said contact spring arms.

* * * * *